US008544838B2

(12) United States Patent
Omori

(10) Patent No.: US 8,544,838 B2
(45) Date of Patent: Oct. 1, 2013

(54) SHEET FEED DEVICE FEEDING PAPER AND IMAGE FORMING APPARATUS

(75) Inventor: Yuichi Omori, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/275,742

(22) Filed: Oct. 18, 2011

(65) Prior Publication Data

US 2012/0098185 A1 Apr. 26, 2012

(30) Foreign Application Priority Data

Oct. 25, 2010 (JP) ..... 2010-238280

(51) Int. Cl.
*B65H 3/14* (2006.01)

(52) U.S. Cl.
USPC ..... 271/97; 271/98; 271/105; 271/90; 271/2

(58) Field of Classification Search
USPC ..... 271/97, 98, 105, 90, 2
See application file for complete search history.

(56) References Cited

U.S. PATENT DOCUMENTS

| | | | | |
|---|---|---|---|---|
| 7,841,591 | B2 * | 11/2010 | Ueda et al. | 271/98 |
| 8,074,978 | B2 * | 12/2011 | Takahashi | 271/97 |
| 8,186,668 | B2 * | 5/2012 | Wardak et al. | 271/97 |
| 2009/0283958 | A1 * | 11/2009 | Takahashi | 271/12 |

FOREIGN PATENT DOCUMENTS

| | | |
|---|---|---|
| JP | 2006-264980 | 10/2006 |
| JP | 2008-87906 | 4/2008 |
| JP | 2010-137963 | 6/2010 |

* cited by examiner

*Primary Examiner* — Luis A Gonzalez
(74) *Attorney, Agent, or Firm* — Finnegan, Henderson, Farabow, Garrett & Dunner, L.L.P.

(57) ABSTRACT

A sheet feed device feeding paper including; a loading platen loaded with sheets; a ventilation section providing a first ventilation port for blowing air to float a first side of a sheet of one sheet of the sheets loaded on the loading platen, and a second ventilation port for blowing air to float a second side opposed to the first side; and a control section for controlling the ventilation section; wherein the first side is a side of a topmost of loaded envelopes, the side of which height is lower than other sides, and when envelopes are to be fed, the control section controls the ventilation section to change air volume of the first ventilation port and the second ventilation port so as to float the first side more greatly than in case when sheets other than envelopes are fed.

25 Claims, 10 Drawing Sheets

SHEET FEED DEVICE FEEDING PAPER AND IMAGE FORMING APPARATUS

RELATED APPLICATION

The present application is based on Patent Application No. 2010-238280 filed at the Japan Patent Office on Oct. 25, 2010 and which is hereby incorporated herein in its entirety.

TECHNICAL FIELD

The present invention relates to a sheet feed device for supplying sheets and an image forming apparatus equipped with the sheet feed device.

BACKGROUND

In the sheet feed device for supplying sheets to the image forming position of the image forming apparatus, a technique has been developed to float the loaded sheet by blowing air thereto in order to ensure stable sheet feed independently of the properties and size of the sheet.

In a proposal disclosed in the Japanese Patent Application Publication No. 2006-264980 and Japanese Patent Application Publication No. 2010-137963, a sensor is used to detect the sheet floated by air. Based on the result of detection, the volume of air blown to the loaded sheet is controlled to provide a stable sheet feed.

In the Japanese Patent Application Publication No. 2008-87906, to ensure stable feed of various types of sheets different in sheet size, basis weight and surface roughness, air is blown close to the trailing edge of loaded sheets in the traveling direction.

In recent years, an image forming apparatus using electrophotographic process has come to be employed in the field of printing. A great advantage of omitting a plate making process is provided if the image forming apparatus using electrophotographic process is used in printing. To put it more specifically, when the image forming apparatus using electrophotographic process is used in printing, sheets can each be printed with different patterns. As a result, the image forming apparatus is used as a printing machine for printing an address on an envelope.

When an address is printed on the envelope, an envelope is used as a sheet. The envelope is not a regular printing sheet or a flat sheet. It is folded in two or three, and some parts are bonded. The process of feeding the envelope to the image forming section faces a new problem not found in the flat sheet.

The Japanese Patent Application Publication No. 2006-264980, No. 2010-137963 and No. 2008-87906 are intended to ensure stable sheet supply, but not to solve problems in feeding the envelope.

The object of the present invention is to provide a sheet feed device and image forming apparatus equipped therewith, wherein loaded envelopes are separated one by one and are supplied in a stable manner.

SUMMARY

1. To achieve at least one of the abovementioned objects, a sheet feed device feeding paper reflecting one aspect of the present invention including; a loading platen loaded with sheets; a ventilation section providing a first ventilation port for blowing air to float a first side of a sheet of one sheet of the sheets loaded on the loading platen, and a second ventilation port for blowing air to float a second side opposed to the first side; and a control section for controlling the ventilation section; wherein the first side is a side of a topmost of loaded envelopes, the side of which height is lower than other sides, and when envelopes are to be fed, the control section controls the ventilation section to change air volume of the first ventilation port and the second ventilation port so as to float the first side more greatly than in case when sheets other than envelopes are fed.
2. In the abovementioned sheet feed device feeding paper of item 1, wherein the control section controls the ventilation section in such a way that, when envelopes are to be fed, air volume blown from the first ventilation port is increased over air volume blown in case when sheets other than envelopes are to be fed.
3. In the abovementioned sheet feed device feeding paper of item 1, wherein the control section controls the ventilation section in such a way that, when envelopes are to be fed, to stop the blow of air from the second ventilation port and to blow air from the first ventilation port alone.
4. In the abovementioned sheet feed device feeding paper in any one of items 1 through 3, wherein the first ventilation port further includes a front ventilation port which blows air to a front formed by the first side of the loaded sheets, and a lateral ventilation port that blows air to a portion close to the first side on a lateral side formed by the sides each of which is a side of the loaded sheets adjacent to the first side of the loaded sheets.
5. In the abovementioned sheet feed device feeding paper described in any one of items 1 through 4, further including an operation display section to set envelopes or sheets other than envelopes, wherein the control section determines if a current feeding is an envelope feeding or not, based on information of the setting of the operation display section.
6. In the abovementioned sheet feed device feeding paper of item5, wherein a position of a bonded portion of the envelope and a position of a flap of the envelope are set to the operation display section.
7. In the abovementioned sheet feed device feeding paper of item 6, wherein the operation display section through which opening or closing of the flap are set, and the control section controls the ventilation section to change ventilation conditions in response to whether the flap is opened or closed.
8. In the abovementioned sheet feed device feeding paper described in any one of items 1 through 7, further including a sensor for detecting a height of an upper surface of the loaded sheets, wherein the control section checks a sensor signal to determine if the current feeding is an envelope feeding mode or not.

DESCRIPTION OF THE PREFERRED EMBODIMENTS

The following describes the present invention with reference to embodiments, without the present invention being restricted thereto.

<Image Forming Apparatus>

Figure 1:
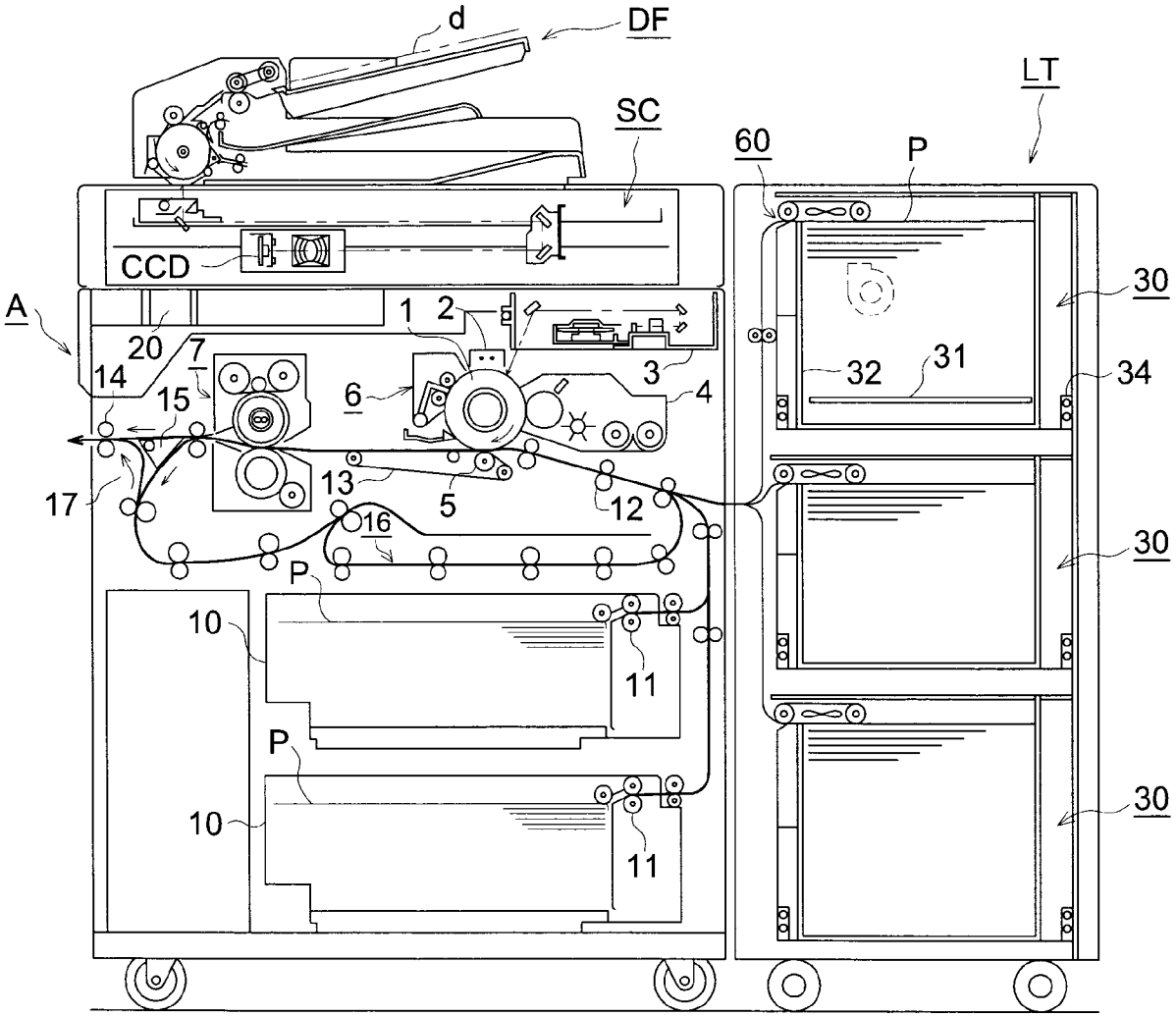
FIG. 1 is a diagram representing the overall structure of an image forming apparatus in an embodiment of the present invention.

FIG. 1 is a diagram representing the overall structure of an image forming apparatus in an embodiment of the present invention. The image forming apparatus includes an image forming apparatus main body A, image reading device SC, automatic document feeder DF and large-capacity sheet feed device LT.

The illustrated image forming apparatus main body A has an image forming section made up of a photoreceptor (image carrier) 1, charging means 2, image exposure device 3, development device 4, transfer means 5, cleaning means 6, fixing device 7, sheet conveyance system.

The sheet conveyance system is formed of a first sheet feed means 11, second sheet feed means 12, sheet ejection means 14, conveyance path switching means 15, recycled sheet feed means 16, reversed sheet ejection means 17. In the image forming section, sheets P are fed out of two sheet feed cassettes 10 by the first sheet feed means 11.

The document d placed on the document platen of the automatic document feeder DF is conveyed by the sheet feed means, then the image on one side or both sides of the document d is read by the optical system of the image reading device SC, and is captured into the image sensor CCD. The analog signal subjected to photoelectric conversion by the image sensor CCD is subjected to analog processing, analog-to-digital conversion, shading correction, image compression in the image processing section 20. After that, this signal is sent to the image exposure device 3 as an image signal.

In the image forming section, image forming operation is performed by such electrophotographic process as charging, exposure, development, transfer, separation, and cleaning.

In the image forming section, the photoreceptor 1 is charged by the charging means 2 (negatively charged in the present embodiment), and an electrostatic latent image is formed by the laser beam applied from the image exposure device 3. The electrostatic latent image is developed by the development device 4 and is converted into a toner image (negatively charged in the present embodiment). In the meantime, the sheets P accommodated in the sheet feed cassette 10 are conveyed from the first sheet feed means 11. The sheets P are synchronized with the toner image by the second sheet feed means 12 composed of a registration roller and are conveyed. After that, the toner image is transferred onto the sheet P by the transfer means 5, and the toner image transferred to the sheet P is fixed in position by the fixing device 7.

The sheet P with the image fixed thereon is ejected out of the apparatus by the sheet ejection means 14. In the meantime, the cleaning means 6 removes the toner remaining on the photoreceptor 1 after transfer. In the duplex copying mode, the sheet P with an image formed on the first side is fed to the recycled sheet feed means 16, wherein the sheet P is reversed. In the image forming means, an image is again formed on the second side, and is ejected out of the apparatus by the sheet ejection means 14. At the time of sheet reversal and ejection, the sheet P branched from the regular sheet ejection path is switched back by the reversed sheet ejection means 17 and is reversed. After that, the sheet P is ejected out of the apparatus by the sheet ejection means 14.

The image forming apparatus main body A is connected with a large-capacity sheet feed device LT. The large-capacity sheet feed device LT includes a three-tier sheet feed unit 30. Each tier of the three-tier sheet feed unit 30 is provided with an adsorption conveying mechanism 60. A large volume of sheets P are accommodated in the adsorption conveying mechanism, and are fed one by one to the image forming apparatus main body A.

<Sheet Feed Device (Embodiment 1)>

Figure 2:
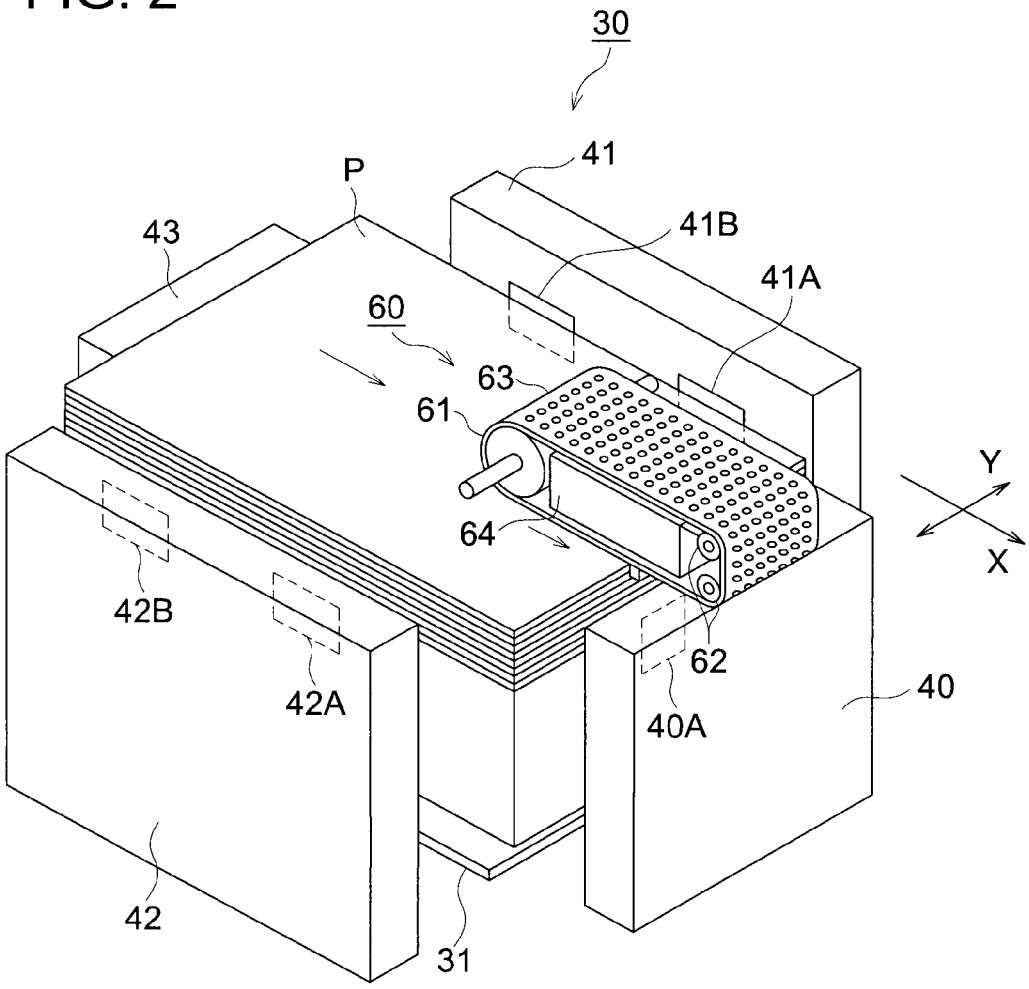
FIG. 2 is a perspective view representing a sheet feed device in the embodiment 1 of the present invention.
Figure 3:
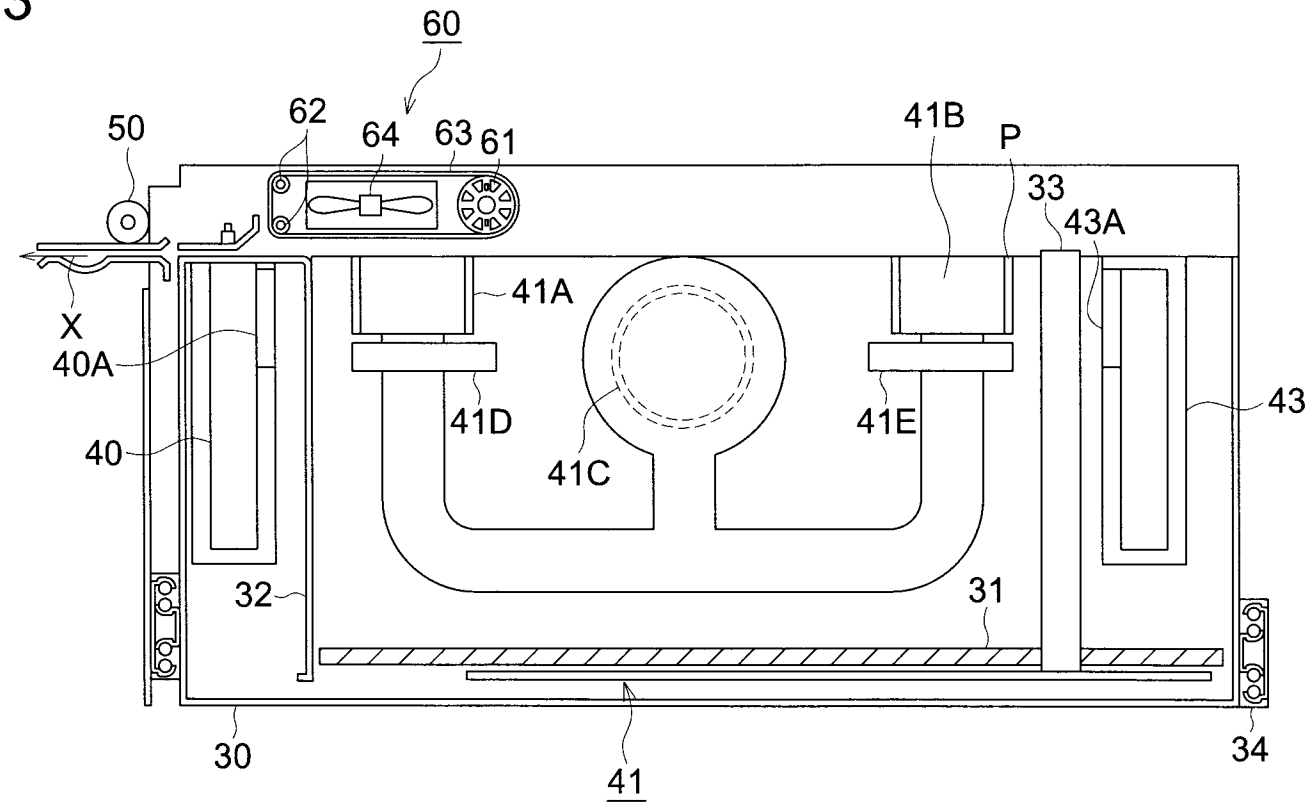
FIG. 3 is a cross sectional view of the sheet feed device as viewed from the front.

FIG. 2 is a perspective view representing a sheet feed device in the embodiment 1 of the present invention. FIG. 3 is a cross sectional view of the sheet feed device as viewed from the front. The sheet feed unit 30 as a sheet feed device has a structure shown in FIGS. 2 and 3.

In FIGS. 2 and 3, the sheet P is loaded on the loading platen 31, and is accommodated in such a way that the sheets P can be moved in the vertical direction by an elevation mechanism (not illustrated). The elevation mechanism is a conventionally known mechanism that moves the loading platen 31 in the vertical direction to keep the topmost surface of the loaded sheets P at a constant level at all times.

The arrow X indicates the traveling direction of the sheet Pin the sheet feed device. The arrow Y is an in-plane direction of the sheet and is the cross direction perpendicular to the traveling direction X.

As shown in the Japanese Unexamined Patent Application Publication No. 2009-208945 for example, in the sheet feed device of FIG. 2, the loaded sheets P are floated by blowing of air, and are fed after being separated into each sheet by the adsorption conveying mechanism 60. It is also possible to use the sheet feed device disclosed in the Japanese Unexamined Patent Application Publication No. 2008-87906 wherein the loaded sheets P are floated by blowing of air, and are fed after being separated into each sheet by the sheet feed unit formed of rollers.

A ventilation section is arranged on each of the front, back, right and left of the loading platen 31. This ventilation section is made up of ventilation units 40, 41, 42 and 43.

The ventilation unit 40 blows air from upstream to downstream along the traveling direction X. Air is blown to the front of the sheets P loaded on the loading platen 31. To be more specific, the ventilation unit 40 blows air downstream from the leading edge of the loaded sheets P to float the leading edge of the sheets P. The ventilation unit 41 blows air to the side of the sheets P (left side as viewed from the traveling direction X) loaded on the loading platen 31. To put it another way, the ventilation unit 41 allows the left end of the sheet P to float, as viewed from the traveling direction X. The ventilation unit 42 blows air to the side of the sheets P (right side as viewed from the traveling direction X) loaded on the loading platen 31. To put it another way, the ventilation unit 42 allows the right end of the sheet P to float, as viewed from the traveling direction X. The ventilation unit 43 blows air to the back side of the sheets P loaded on the loading platen 31.

To put it another way, the ventilation unit 43 allows the trailing edge of the sheet P to float, as viewed from the traveling direction X. As will be described later, the ventilation units 40, 41, 42 and 43 is provided with multi-functional floating functions including, for example, a function of allowing the right or left edges of the sheet P to float in collaboration with the ventilation unit 43, in addition to the function wherein the ventilation unit 40 arranged opposed to the leading edge of the sheet P allows the leading edge of the sheet P to float.

Figure 4:
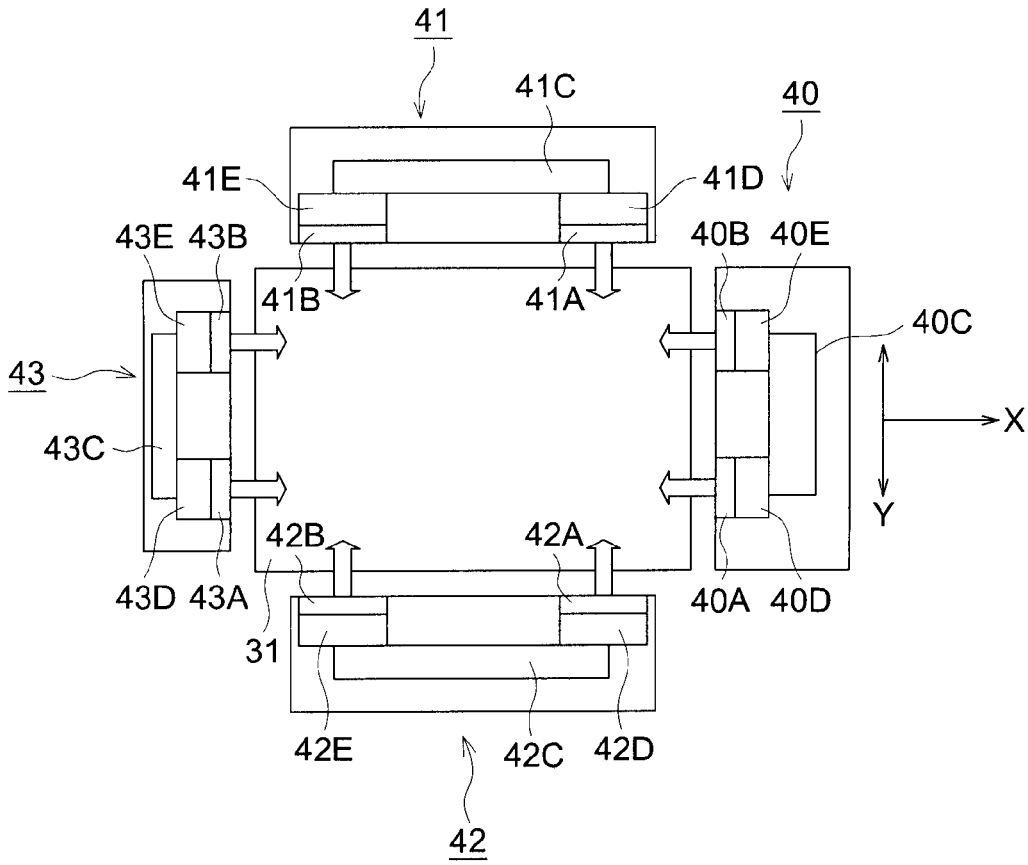
FIG. 4 is a diagram showing the structure of the sheet feed device.

FIG. 4 is a diagram showing the structure of the sheet feed device. As shown schematically in FIG. 4, the ventilation unit 40 includes two ventilation ports 40A and 40B, and a ventilation source 40C provided with a ventilation fan and duct. The ventilation unit 41 includes two ventilation ports 41A and 41B, and a ventilation source 41C provided with a ventilation fan and duct. The ventilation unit 42 includes two ventilation ports 42A and 42B, and a ventilation source 42C provided with a ventilation fan and duct. The ventilation unit 43 includes two ventilation ports 43A and 43B, and a ventilation source 43C provided with a ventilation fan and duct.

The ventilation port 40A is provided with a shutter 40D, the ventilation port 40B with a shutter 40E, the ventilation port 41A with a shutter 41D, the ventilation port 41B with a shutter 41E, the ventilation port 42A with a shutter 42D, the ventilation port 42B with a shutter 42E, the ventilation port 43A with a shutter 43D, and the ventilation port 43B with a shutter 43ED.

These shutters fully open or fully close the opening. Further, these shutters partially close the opening to adjust the volume of air to be blown.

The volume of float of the sheet P can be fine-controlled by adjusting the air volume. The air volume can be adjusted by controlling the output of the ventilation fan.

The adsorption conveying mechanism 60 is provided with an adsorption belt 63 that is driven and rotated by a large roller 61 and two small rollers 62 connected to a drive source (not illustrated). The adsorption belt 63 is provided with a great number of through-holes. The absorption means 64 is arranged on the inner side of the adsorption belt 63. The adsorption belt 63 conveys the sheet P by absorption. The topmost one of the sheets P floated by air from the ventilation units 40 through 43 is adsorbed by the adsorption conveying mechanism 60. The adsorbed sheet P is fed by the adsorption belt 63 in the traveling direction X, and is conveyed by the conveyance roller 50 until it reaches the image forming apparatus main body A (see FIG. 1).

The following describes the procedure of loading the sheet feed device with an envelope HP as a sheet P and feeding it for the purpose of forming an image thereon.

There are various forms of envelopes. FIG. 5 shows an example.

Figure 5A:
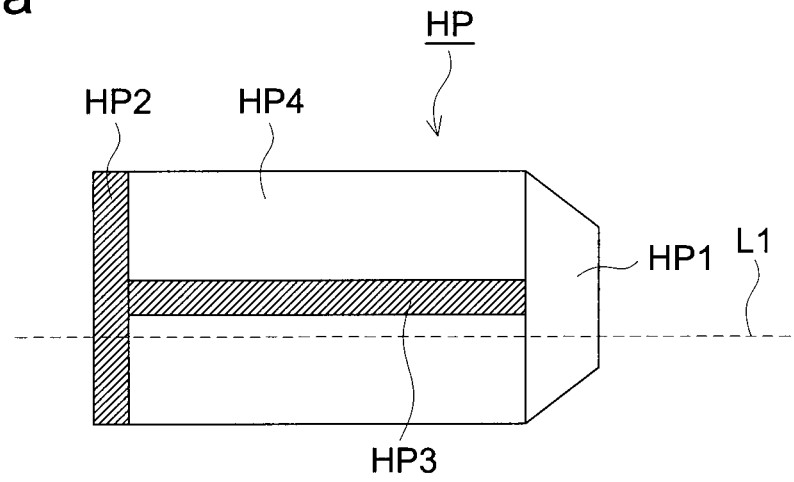
FIG. 5*a* is a diagram showing an example of an envelope.

In FIG. 5A, the envelope HP consists of an accommodation portion and flap HP1. The accommodation portion is formed of bonded portions HP2 and HP3, and an accommodation portion main body HP4. The bonded portion HP2 is formed by folding the extension of the accommodation portion and bonding it to the accommodation portion. The bonded portion HP3 is formed by bonding the extensions from both sides of the accommodation portion.

Figure 5B:
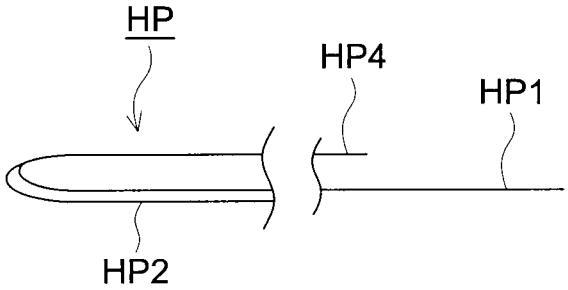
FIG. 5*b* is a diagram showing an example of an envelope.

FIG. 5B is a cross sectional view taken along the broken line L1.

As shown in FIG. 5B, the thickness of the flap HP1 is equivalent to that of one sheet of paper. The thickness of the accommodation portion main body HP4 is equivalent to the thickness of two sheets of paper plus the space between sheets of paper.

By contrast, the thickness of the bonded portion HP2 is equivalent to that of three sheets of paper plus the space between sheets of paper.

When sheets having thicknesses different according to various parts are loaded, the upper side of the topmost sheet is inclined, as shown in FIG. 5B.

Figure 5C:
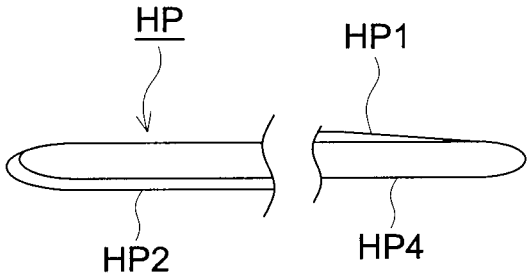
FIG. 5*c* is a diagram showing an example of an envelope.

FIG. 5C shows the envelope HP with the flap HP1 closed. In the envelope HP with the flap HP1 closed, the flap HP1 is unbonded, and therefore, the space between sheets is increased, with the result that the end of the envelope HP with the flap HP1 formed thereon is higher. Thus, when loaded with the envelope HP with the flap HP1 closed, inclination occurs in such a way that the end of the envelope HP with the flap HP1 formed thereon tends to be higher, while the side of the bonded portion HP2 tends to be lower.

To ensure stable sheet feed in the mode wherein one sheet is separated from the loaded sheets and is fed, the optimum conditions are obtained when the topmost one of the loaded sheets is kept in the horizontal position. If the topmost sheet is much deviated from the horizontal position, a sheet feed error such as a pickup error will occur. That is, as shown in FIG. 6, if the surface (indicated by dotted line L2) of the topmost envelope HP is inclined from the horizontal position, a sheet feed error tends to occur. FIG. 6 is a diagram schematically showing the loaded envelopes.

In the present embodiment, stable sheet feed is ensured in the mode of feeding the envelope HP as well, by controlling the volume of air blown from the ventilation units 40 through 43, as will be explained below.

Figure 6A:
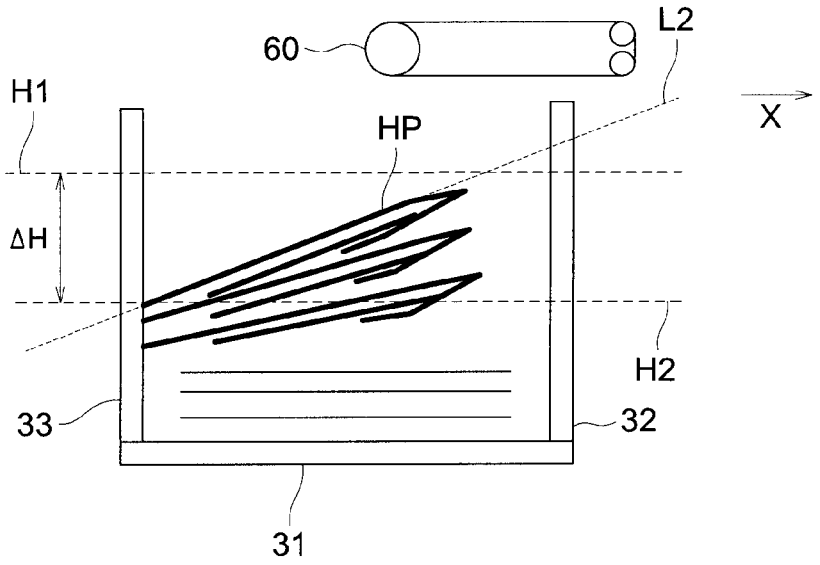
FIG. 6*a* is a diagram schematically showing the envelopes loaded on a loading platen.

As shown in the example of FIG. 6A, when feeding the envelope HP inclined as shown by the dotted line L2 wherein the leading edge is higher in the traveling direction X and the trailing edge is lower, air is blown from the ventilation ports 41B and 42B arranged backward of the ventilation units 41 and 42 that provide ventilation from the side of the loaded envelopes HP. By doing so, the lower side of the topmost envelope HP, namely, the trailing edge of the envelope HP in the traveling direction X is floated to a level higher than other sides so that the topmost envelope HP is placed in the horizontal position or close to the horizontal position. If the topmost envelope HP is placed in the horizontal position or close to the horizontal position, the topmost envelope HP is sucked by the adsorption conveying mechanism 60 with certainty and is conveyed. This provides a surefire means for separation and conveyance, with the result that smooth and stabled sheet feed operation is performed.

In the example of FIG. 6A, envelopes HP are loaded in such a way that the open flap HP1 will be the trailing edge. If ventilation is applied to the rear, namely, in the traveling direction X under this loading conditions to blow air to the envelope HP, air will enters the envelope HP, and the envelope HP will be inflated with air. To avoid this, the sheet floating air is blown from the ventilation ports 41B and 42B on the rear ends of the ventilation units 41 and 42 on both ends of the loading platen 31. This procedure allows the trailing edge of the envelope HP to float to a considerable degree, while preventing air from entering the envelope HP.

Figure 6B:
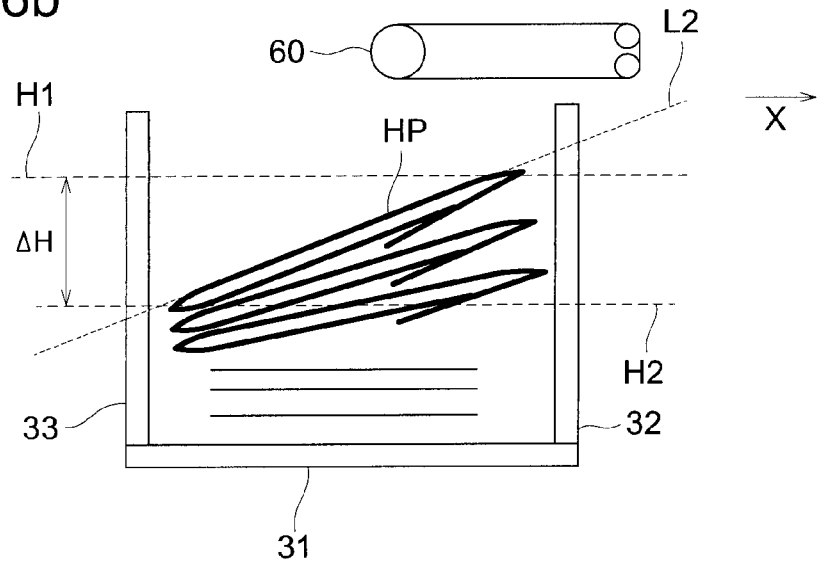
FIG. 6*b* is a diagram schematically showing the envelopes loaded on a loading platen.

FIG. 6B shows an example of the envelopes HP loaded in such a way that the closed flap HP1 will become the leading edge in the traveling direction X. In the envelope HP with the flat HP1 closed, envelopes HP are loaded in the state of inclination wherein the leading edge with folding is made higher than the bonded portion on the rear by the folding of the flap HP1. In the example of FIG. 6B, similarly to the case of FIG. 6A, air is blown to the trailing edge of the envelope HP to float the trailing edge to a larger degree. However, in FIG. 6B, the envelope HP is made to float by blowing air from the ventilation ports 43A and 43B that allow air to blow in the traveling direction X. In the example of FIG. 6B, the trailing edge of the envelope HP is closed, and therefore, blowing air in such a manner as described here does not allow entry of air into the envelope HP.

The following summarizes the control of ventilation in the sheet feed operation described with reference to FIG. 6A and FIG. 6B.

In the loaded state wherein the first side (the trailing edge of the envelope HP in FIG. 6) of the envelope HP is lower, air is blown to the envelope HP from the first ventilation port so that the first side is floated to a level much higher than that when the flat sheet P is fed.

In FIG. 6A, air is blown from the ventilation ports 41B and 42B, whereas in FIG. 6B, air is blown from the ventilation ports 43A and 43B. As will be apparent from this, the first ventilation port that allows the first side of the envelope HP to float to a higher level consists of ventilation ports 41B and 42B or the ventilation ports 43A and 43B. The second ventilation port consists of the ventilation ports 41A and 42A in the example of FIG. 6(*a*), and consists of the ventilation ports 40A and 40B in the example of FIG. 6(*b*).

The ventilation ports 43A and 43B are the front ventilation ports for blowing air to the front of the loaded envelopes HP formed by overlapping of the higher floating first sides of the envelopes HP. By contrast, the ventilation port 41B is a lateral ventilation port for blowing air to the left side of the loaded envelopes HP formed by overlapping of the sides adjacent to the higher floating first sides of the envelopes HP. The ventilation port 42B is a lateral ventilation port for blowing air to the right side of the loaded envelopes HP formed by overlapping of the sides adjacent to the higher floating first sides of the envelopes HP.

As described above, the loaded envelopes HP have an inclination with a higher leading edge and lower trailing edge. They also can have an inclination with a higher trailing edge and lower leading edge; an inclination with a higher end of left side and lower right end as viewed from the traveling direction X; and an inclination with a higher end of right side and lower left side.

The actually occurring inclination out of these four types is determined by the direction of the loaded sheets, open/close status of the flap HP1, and type of the envelope. In conformity to the type of inclination of the loaded envelopes HP, the proper ports are selected from among the ventilation ports 40A, 40B, 41A, 41B, 42A, 42B, 43A and 43B, from which air is blown.

The ends of the envelope HP are floated to a large degree by the selection of the ventilation ports, as shown in Table 1.

TABLE 1

| Operating ventilation port (First ventilation port) | Portion of the envelope HP floated to a large degree |
|---|---|
| 40A, 40B | Leading edge |
| 41A, 41B | End of left side |
| 42A, 42B | End of right side |
| 43A, 43B | Trailing edge |
| 41A, 42A | Leading edge |
| 40B, 43B | End of left side |
| 40A, 43A | End of right side |
| 41B, 42B | Trailing edge |

The first ventilation port in Table 1 is used to float the first side of the envelope HP to a large degree.

In the operations of the aforementioned ventilation units 40, 41, 42 and 43 a pair of the first ventilation ports operate, but other ventilation ports do not operate. However, it is also possible to arrange such a configuration that all ventilation ports operate to blow air.

In this case, a pair of first ventilation ports blow air, and other ventilation ports also blow air, according to the Correspondence Table of Table 1. A pair of the first ventilation ports of Table 1 blow a greater volume of air than other ventilation ports, and the first side of the envelope HP is floated to a greater extent so that the envelope HP is floated in the horizontal position.

Each of the ventilation units 40, 41, 42 and 43 has a ventilation source. Further, each of the ventilation ports 40A, 40B, 41A, 41B, 42A, 42B, 43A and 43B is provided with a shutter:

Blowing of air from each of ventilation ports 40A, 40B, 41A, 41B, 42A, 42B, 43A and 43B is controlled by the control of each of the shutters.

Figure 7:
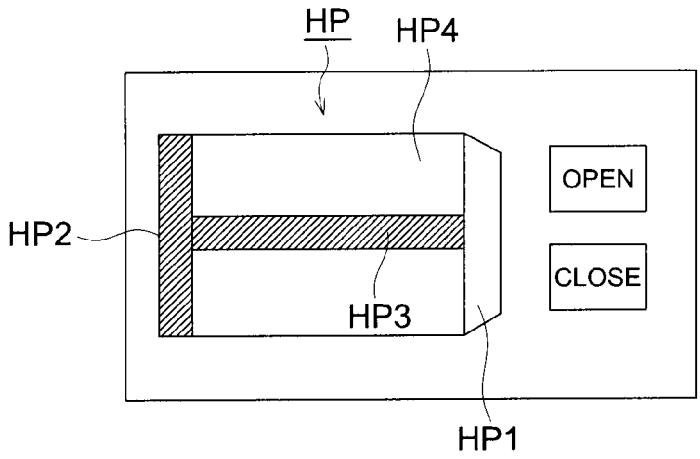
FIG. 7 is a diagram showing an operation display section operated by an operator when the envelope HP is set on the sheet feed device.

FIG. 7 is a diagram showing an operation display section operated by an operator when the envelope HP is set on the sheet feed device.

As shown in FIG. 7, the envelope HP is displayed on the screen. Although there are many types of envelopes HP, a desired type can be selected on the operation display section. When one type is selected, the envelope HP of FIG. 7, for example, is displayed.

When the operator touches the HP1, the position of the flap HP1 is set. When the HP2 or HP3 is touched, the position of the bonded portion is set.

When the "Open" button or "Close" button is selected, the envelope HP with the flap HP1 opened, or the envelope HP with the flat HP1 closed is set. FIG. 7 shows that the envelope HP with the flap HP1 opened is selected. If the envelope HP with the flat HP1 closed is selected, the color of the flap HP1 changes.

The aforementioned setting on the operation display section determines which end portion of the envelope HP set on the sheet feed device should be floated to a higher level. Ventilation from ventilation ports is controlled according to this decision.

Figure 8:
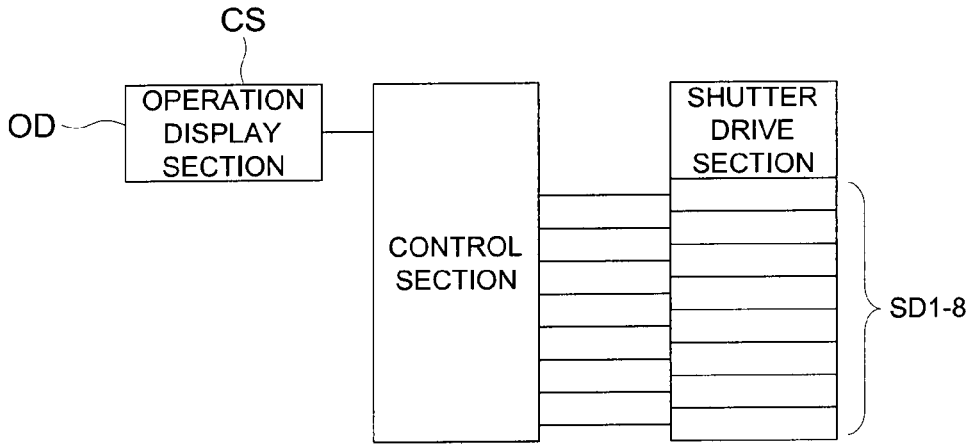
FIG. 8 is a block diagram of the control system for ventilation control in the sheet feed device.

FIG. 8 is a block diagram of the control system for ventilation control in the sheet feed device.

In conformity to the setting information from the operation display section OD, the control section CS controls the shutter drive section SD1 through SD8 consisting of a solenoid or motor for opening and closing ventilation ports 40A, 40B, 41A, 41B, 42A, 42B, 43A and 43B. The control section CS controls the operations shown in Table 1.

As described above, the shutter drive section SD can be provided with the on/off function for opening or closing the shutter, or one or more partially opened states on intermediate levels between the opening and closing operations.

Figure 9:
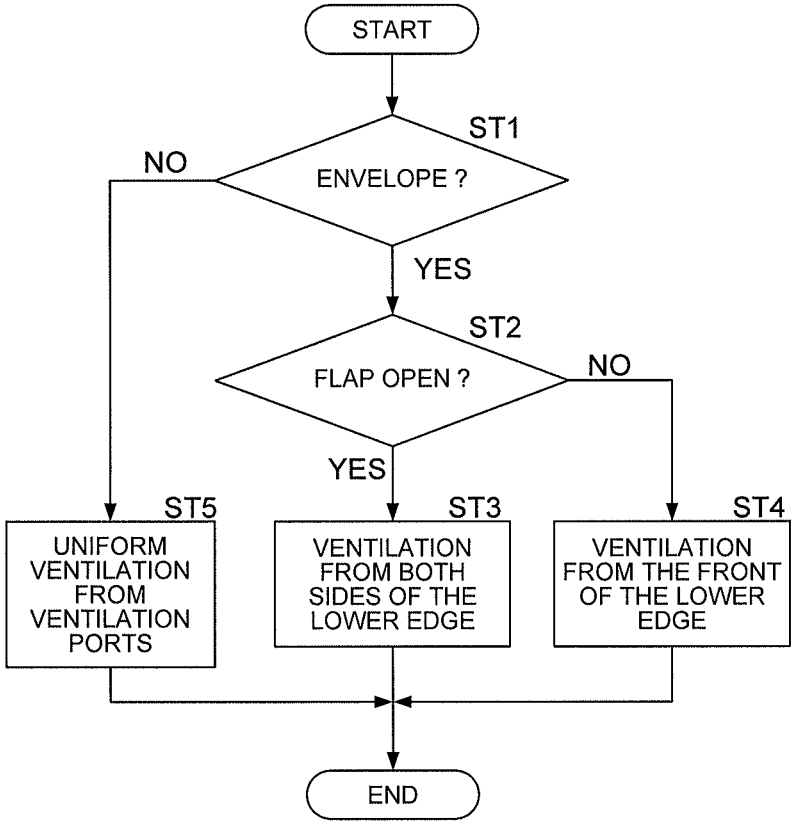
FIG. 9 is a flow chart representing the sheet feed control in the embodiment 1.

FIG. 9 is a flow chart representing the sheet feed control in the step of feeding out sheets from the sheet feed device.

In Step ST1, a decision is made to see whether envelopes HP are to be controlled or whether other than the envelopes HP is to be fed. This step is taken in conformity to the settings of the operation display section OD. As described above, the settings of the envelope HP include information on the inclination and direction of the envelopes, and information for determining the open/close status of the flap.

When the ST1 is "N", namely, when other than envelopes HP are to be fed, uniform air ventilation is given from the ventilation ports 40A, 40B, 41A, 41B, 42A, 42B, 43A and 43B in Step ST5. If other than envelopes are to be fed, namely, if the flap sheet feed mode is to used, uneven air ventilation will be provided in ST5, when uniform ventilation is not the optimum conditions for ventilation from the ventilation ports 40A, 40B, 41A, 41B, 42A, 42B, 43A and 43B and, for example, when the optimum condition is met by the increased air volume in the leading edge of the sheet P.

When the ST1 is "Y", namely, when envelope HP is to be controlled, a decision is made to see whether or not the flap HP1 is opened or not. If the flap HP1 is open (Y in ST2), ventilation is provided so that the side of flap HP1 is floated to a greater extent, as described above. In this ventilation process, as described above, the lateral ventilation port on the portion closer to the flap HP1 on both sides sandwiching the flap HP1 side of the envelope HP is opened, while other ventilation ports are closed.

For example, in the presence of a flat HP with the leading edge of the envelope HP opened, ventilation is provided from the ventilation ports 41A and 41B on the downstream edge of the ventilation units 41 and 42 in the traveling direction X of FIG. 4.

If the flap HP1 is not open according to the decision step of ST2 (N in ST2), namely, if the flap HP1 is closed, ventilation is provided in Step ST4 in such a way that the front ventilation port for blowing air to the side opposed to the side containing the flap HP1 on the envelope HP is opened, while other ventilation ports are closed. For example, in the presence of a flap HP1 with the leading edge of the envelope HP being closed, ventilation is provided from the ventilation ports 43A and 43B of the ventilation unit 43 so that air is blown in the traveling direction X of FIG. 4.

<Sheet Feed Device (Embodiment 2)>

Figure 10:
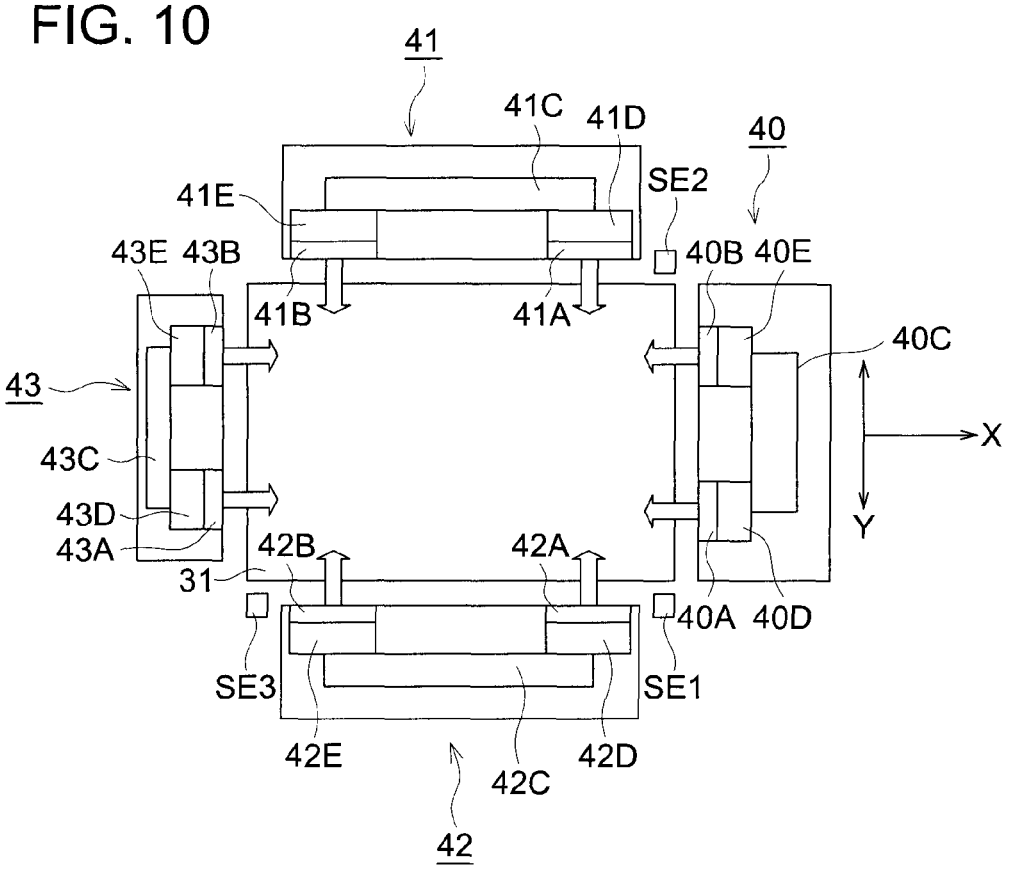
FIG. 10 is a diagram showing the structure of the sheet feed device in the embodiment 2 of the present invention.
Figure 11:
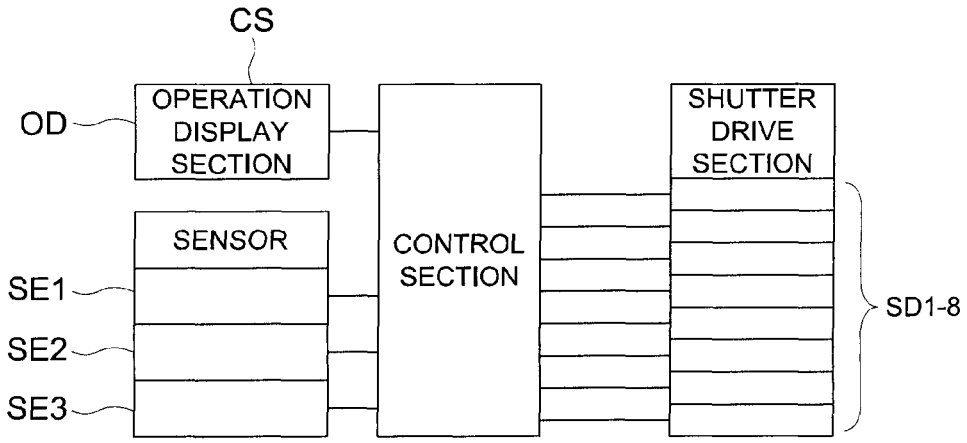
FIG. 11 is a block diagram showing the control system in the embodiment 2.
Figure 12:
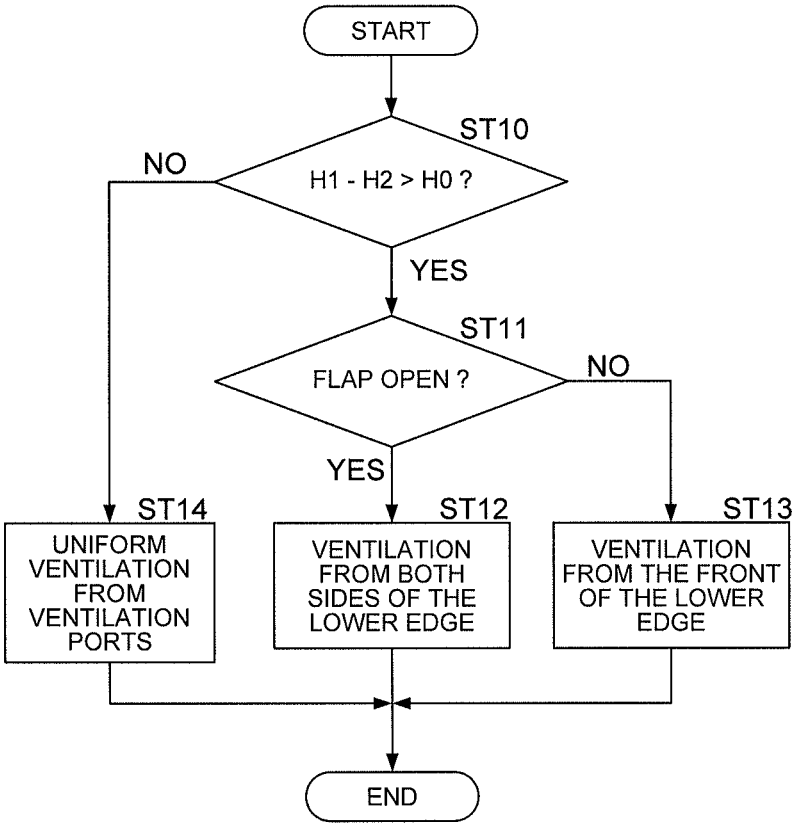
FIG. 12 is a flow chart showing the sheet feed control in the embodiment 2.

FIG. 10 is a diagram showing the structure of the sheet feed device in the embodiment 2 of the present invention. FIG. 11 is a block diagram showing the control system in the embodiment 2. FIG. 12 is a flow chart showing the control in the embodiment 2.

In the embodiment 2, the sensors SE1 through SE3 for detecting the height of three corners of the sheet P are installed, as shown in FIG. 10.

Each of the sensors SE1 through SE3 detects the height of the topmost surface of the loaded sheets P. The sensors to be used include a reflection type sensor, a microswitch equipped with an actuator in contact with the upper side of the sheet P, or a photo interrupter type sensor. The difference in sheet heights ΔH in FIG. 6 is detected from the signals from the sensors SE1 through SE3.

Inclination of the sheet P in the cross direction Y perpendicular to the traveling direction and the degree of inclination are detected from the signals of the sensor SE1 and sensor SE2. Inclination of the sheet P in the traveling direction X and the degree of inclination are detected from the signals of the sensor SE1 and sensor SE3.

In response to the detection signals from the sensors SE1 through SE3, the control section CS of FIG. 11 controls the ventilation shown in FIG. 12.

In Step ST10, a decision is made to see whether or not the difference in sheet heights ΔH=H1−H2 is greater than a prescribed threshold value H0. If the difference in sheet heights ΔH=H1−H2 is equal to or less than the prescribed threshold value H0, the control section CS determines that the sheet P is not an envelope HP (N in ST10). If the difference in sheet heights ΔH=H1−H2 is greater than the prescribed threshold value H0, the control section CS determines that the sheet P is an envelope HP (Y in ST10).

If the ST10 is "N", namely, if the sheet is not an envelope HP, uniform air ventilation is provided from the ventilation ports 40A, 40B, 41A, 41B, 42A, 42B, 43A and 43B in Step ST14. If the sheet is not an envelope HP, namely, if the flat sheet feed mode is used, uneven ventilation will be provided from the ventilation ports 40A, 40B, 41A, 41B, 42A, 42B, 43A and 43B, depending on particular cases, as described above.

To put it another way, in the case of "Y" in ST10 wherein the envelope HP is fed, a decision is made in ST11 to see whether the flap HP1 is open or not. If the flap HP1 is open (Yin ST11), ventilation is performed so that the side with flap HP1 is floated to a greater extent, as described above. In this ventilation, the lateral ventilation port on the portion closer to the flap HP1 on both sides sandwiching the flap HP1 side of the envelope HP is opened, while other ventilation ports are closed, as described above.

If the flap HP1 is not opened in the step of decision in ST11 (N in ST2), namely, if the flap HP1 is closed, ventilation is provided in Step ST3 in such a way that the front ventilation port for blowing air to the side opposed to the side containing the flap HP1 on the envelope HP is opened, while other ventilation ports are closed.

Control of the embodiment 1 can be combined with that of the embodiment 2.

That is, the following control can be provided: Even when the envelope has been set in the operation display section OD, the volume of air from a specific ventilation port is increased by a medium level, if the difference in sheet heights ΔH in FIG. 6 is equal to or less than a prescribed value. If the difference in sheet heights ΔH has exceeded a prescribed value, the volume of air from a specific ventilation port is maximized.

In the present embodiment, when the loaded sheets are envelopes, envelopes are floated and are fed after selection of the ventilation condition wherein the side of the topmost envelope characterized by lower top surface is floated to a level higher than other sides.

This arrangement ensures horizontal floating of the topmost envelope loaded in a tilted condition, and hence smooth stable sheet supply.

What is claimed is:

1. A sheet feed device feeding paper comprising:

a loading platen loaded with sheets;

a ventilation section providing a first ventilation port for blowing air to float a first side of a sheet of one sheet of the sheets loaded on the loading platen, and a second ventilation port for blowing air to float a second side opposed to the first side; and a control section for controlling the ventilation section;

wherein the first side is a side of a topmost of loaded envelopes and has a height that is lower than other sides, and when envelopes are to be fed, the control section controls the ventilation section to change air volume of the first ventilation port and the second ventilation port in such a way to stop the blow of air from the second ventilation port and to blow air from the first ventilation port alone so as to float the first side more greatly than when sheets other than envelopes are fed.

2. The sheet feed device feeding paper of claim 1, wherein the first ventilation port further comprises a front ventilation port which blows air to a front formed by the first side of the loaded sheets, and a lateral ventilation port that blows air to a portion close to the first side on a lateral side formed by the sides each of which is a side of the loaded sheets adjacent to the first side of the loaded sheets.

3. The sheet feed device feeding paper of claim 1, further comprising an operation display section to set envelopes or sheets other than envelopes, wherein the control section determines if a current feeding is an envelope feeding or not, based on information of the setting of the operation display section.

4. The sheet feed device feeding paper of claim 3, wherein a position of a bonded portion of the envelope and a position of a flap of the envelope are set to the operation display section.

5. The sheet feed device feeding paper of claim 4, wherein opening or closing of the flap is set through the operation display section, and the control section controls the ventilation section to change ventilation conditions in response to whether the flap is opened or closed.

6. The sheet feed device feeding paper of claim 1, further comprising a sensor for detecting a height of an upper surface of the loaded sheets, wherein the control section checks a sensor signal to determine if the current feeding is an envelope feeding mode or not.

7. A sheet feed device feeding paper comprising:

a loading platen loaded with sheets;

a ventilation section providing a first ventilation port for blowing air to float a first side of a sheet of one sheet of the sheets loaded on the loading platen, and a second ventilation port for blowing air to float a second side opposed to the first side;

an operation display section to set envelopes or sheets other than envelopes; and a control section for controlling the ventilation section, wherein the control section determines if a current feeding is an envelope feeding or not, based on information of the setting of the operation display section, wherein the first side is a side of a topmost of loaded envelopes, the side of which height is lower than other sides, and when envelopes are to be fed, the control section controls the ventilation section to change air volume of the first ventilation port and the second ventilation port so as to float the first side more greatly than when sheets other than envelopes are fed, and wherein a position of a bonded portion of the envelope and a position of a flap of the envelope are set to the operation display section.

8. The sheet feed device feeding paper of claim 7, wherein the control section controls the ventilation section in such a way that, when envelopes are to be fed, air volume blown from the first ventilation port is increased over air volume blown when sheets other than envelopes are to be fed.

9. The sheet feed device feeding paper of claim 7, wherein, when envelopes are to be fed, the control section controls the ventilation section in such a way that stops the blow of air from the second ventilation port and blows air from the first ventilation port alone.

10. The sheet feed device feeding paper of claim 7, wherein opening or closing of the flap is set through the operation display section, and the control section controls the ventilation section to change ventilation conditions in response to whether the flap is opened or closed.

11. The sheet feed device feeding paper of claim 7, wherein the first ventilation port further comprises a front ventilation port which blows air to a front formed by the first side of the loaded sheets, and a lateral ventilation port that blows air to a portion close to the first side on a lateral side formed by the sides each of which is a side of the loaded sheets adjacent to the first side of the loaded sheets.

12. A sheet feed device feeding paper comprising:

a loading platen loaded with sheets;

a ventilation section providing a first ventilation port for blowing air to float a first side of a sheet of one sheet of the sheets loaded on the loading platen, and a second ventilation port for blowing air to float a second side opposed to the first side;

a sensor for detecting a height of an upper surface of the loaded sheets; and a control section for controlling the ventilation section, wherein the control section checks a sensor signal to determine if the current feeding is an envelope feeding mode or not, and wherein the first side is a side of a topmost of loaded envelopes, the side of which height is lower than other sides, and, when envelopes are to fed, the control section controls the ventilation section to change air volume of the first ventilation port and the second ventilation port so as to float the first side more greatly than when sheets other than envelopes are fed.

13. The sheet feed device feeding paper of claim 12, wherein the control section controls the ventilation section in such a way that, when envelopes are to be fed, air volume blown from the first ventilation port is increased over air volume blown when sheets other than envelopes are to be fed.

14. The image forming apparatus of claim 12, wherein, when envelopes are to be fed, the control section controls the ventilation section in such a way that stops the blow of air from the second ventilation port and blows air from the first ventilation port alone.

15. The sheet feed device feeding paper of claim 12, wherein the first ventilation port further comprises a front ventilation port which blows air to a front formed by the first side of the loaded sheets, and a lateral ventilation port that blows air to a portion close to the first side on a lateral side formed by the sides each of which is a side of the loaded sheets adjacent to the first side of the loaded sheets.

16. The sheet feed device feeding paper of claim 12, further comprising an operation display section through which a position of a bonded portion of the envelope and a position of a flap of the envelope are set.

17. The sheet feed device feeding paper of claim 16 wherein opening and closing of the flap is set through the operation display section, and the control section controls the ventilation section to change ventilation conditions in response to whether the flap is opened or closed.

18. An image forming apparatus comprising:

a sheet feed device feeding paper; and an image forming section for forming an image on the envelope supplied from the sheet feed device, wherein the sheet feed device comprises;

a loading platen loaded with sheets;

a ventilation section providing a first ventilation port for blowing air to float a first side of a sheet of one sheet of the sheets loaded on the loading platen, and a second ventilation port for blowing air to float a second side opposed to the first side; and a control section for controlling the ventilation section, wherein the first side is a side of a topmost of loaded envelopes, the side of which height is lower than other sides, and when envelopes are to be fed, the control section controls the ventilation section to change air volume of the first ventilation port and the second ventilation port in such a way to stop the blow of air from the second ventilation port and to blow air from the first ventilation port alone so as to float the first side more greatly than in case when sheets other than envelopes are fed.

19. The image forming apparatus of claim 18, wherein the first ventilation port further comprises a front ventilation port which blows air to a front formed by the first side of the loaded sheets, and a lateral ventilation port that blows air to a portion close to the first side on a lateral side formed by the sides each of which is a side of the loaded sheets adjacent to the first side of the loaded sheets.

20. The image forming apparatus of claim 18, further comprising an operation display section through which opening or closing of a flap of the envelope is set, wherein the control section determines if a current feeding is an envelope feeding or not based on information of the setting of the operation display section, and a position of a bonded portion of the envelope and a position of the flap of the envelope are set to the operation display section.

21. An image forming apparatus comprising:

a sheet feed device feeding paper; and an image forming section for forming an image on the envelope supplied from the sheet feed device, wherein the sheet feed device comprises:

a loading platen loaded with sheets;

a ventilation section providing a first ventilation port for blowing air to float a first side of a sheet of one sheet of the sheets loaded on the loading platen, and a second ventilation port for blowing air to float a section side opposed to the first side;

an operation display section to set envelopes or sheets other than envelopes, and a control section for controlling the ventilation section, wherein the control section determines if a current feeding is an envelope feeding or not, based on information of the setting of the operation display section, wherein the first side is a side of a topmost of loaded enveloped, the side of which height is lower than other sides, and, when envelopes are to be fed, the control section controls the ventilation section to change air volume of the first ventilation port and the second ventilation port so as to float the first side more greatly than when sheets other than envelopes are fed, and wherein a position of a bonded portion of the envelope and a position of a flap of the envelope are set to the operation display section.

22. The image forming apparatus of claim 21, wherein the control section controls the ventilation section in such a way that, when envelopes are to be fed, air volume blown from the first ventilation port is increased over air volume blown when sheets other than envelopes are to be fed.

23. The image forming apparatus of claim 21, wherein, when envelopes are to be fed, the control section controls the ventilation section in such a way that stops the blow of air from the second ventilation port and blows air from the first ventilation port alone.

24. The image forming apparatus of claim 21, wherein opening or closing of a flap of the envelope is set through the operation display section, and the control section controls the ventilation section to change ventilation conditions in response to whether the flap is opened or closed.

25. An image forming apparatus comprising:

a sheet feed device feeding paper; and an image forming section for forming an image on the envelope supplied from the sheet feed device, wherein the sheet feed device comprises:

a loading platen loaded with sheets;

a ventilation section providing a first ventilation port for blowing air to float a first side of a sheet of one sheet of the sheets loaded on the loading platen, and a second ventilation port for blowing air to float a second side opposed to the first side;

a sensor for detecting a height of an upper surface of the loaded sheets; and a control section for controlling the ventilation section, wherein the first side is a side of a topmost of loaded envelopes and has a height that is lower than other sides, and, when envelopes are to be fed, the control section checks a sensor signal to determine if the current feeding is an envelope feeding mode or not and controls the ventilation section to change air volume of the first ventilation port and the second ventilation port so as to float the first side more greatly than when sheets other than envelopes are fed.

* * * * *